US008026708B2

(12) United States Patent
Imura

(10) Patent No.: US 8,026,708 B2
(45) Date of Patent: Sep. 27, 2011

(54) VOLTAGE REGULATOR

(75) Inventor: Takashi Imura, Chiba (JP)

(73) Assignee: Seiko Instruments Inc. (JP)

( * ) Notice: Subject to any disclaimer, the term of this patent is extended or adjusted under 35 U.S.C. 154(b) by 388 days.

(21) Appl. No.: 12/380,145

(22) Filed: Feb. 24, 2009

(65) Prior Publication Data

US 2009/0224740 A1 Sep. 10, 2009

(30) Foreign Application Priority Data

Feb. 25, 2008 (JP) ..... 2008-042592

(51) Int. Cl.
*G05F 1/40* (2006.01)

(52) U.S. Cl. ..... 323/285; 323/282

(58) Field of Classification Search ..... 323/282, 323/285, 312, 315, 316, 351
See application file for complete search history.

(56) References Cited

U.S. PATENT DOCUMENTS 6,559,628 B2 * 5/2003 Kim ..... 323/312
7,193,399 B2 * 3/2007 Aikawa ..... 323/282
7,710,090 B1 * 5/2010 Kimura ..... 323/276

OTHER PUBLICATIONS

Patent Abstracts of Japan, publication No. 03-158912, publication date Jul. 8, 1991.

* cited by examiner

*Primary Examiner* — Matthew V Nguyen
(74) *Attorney, Agent, or Firm* — Adams & Wilks

(57) ABSTRACT

A voltage regulator stably operates even when an operating current of a differential amplifier circuit is increased according to an output current. In the voltage regulator, a current mirror circuit for detecting the output current and increasing the operating current of the differential amplifier circuit is provided with a function of providing a delay according to an operation state of the voltage regulator. A simultaneous action of a main feedback system and a feedback system for the output current is eliminated, whereby an internal operating point can be prevented from fluctuating and therefore stability of the operation is improved.

9 Claims, 6 Drawing Sheets

VOLTAGE REGULATOR

BACKGROUND OF THE INVENTION

1. Field of the Invention

The present invention relates to a voltage regulator for outputting a constant voltage, and more particularly, to a reduction in power consumption of a voltage regulator.

2. Description of the Related Art

A voltage regulator is aimed to supply a stable voltage to an electronic device connected to an output, irrespective of fluctuations of an input voltage or output current supplied to a load. The voltage regulator has a wide range of use, and is used for stably operating information devices, portable communication devices, and the like.

In the portable communication devices, to achieve downsizing and lightening of batteries, thereby prolonging the operation time, is a top priority from the viewpoint of nature of the device. For combined attainment of securing a long operation time and downsizing and lightening of the batteries, reduction of power consumption of the device including the voltage regulator is effective.

The power consumption Pd of the voltage regulator is expressed by the following formula (1).

$$Pd = Vin \cdot Iss + (Vin - Vout) \cdot Iout \quad (1)$$

In the formula (1), Vin represents an input voltage into the voltage regulator, Vout represents an output voltage from the voltage regulator, Iout represents an output current supplied from the voltage regulator to a device connected to a load, and Iss represents current consumption that is necessary for operating the voltage regulator itself.

In this case, Vout and Iout are determined based on specifications required for a circuit connected as a load of the voltage regulator. Therefore, in order to reduce the power consumption of the voltage regulator, it is necessary to reduce Vin−Vout, namely, the input/output voltage difference, and to reduce Iss, namely, current consumption of the voltage regulator.

In a voltage regulator having a small input/output voltage difference, which is referred to as a low drop-out (LDO) voltage regulator, a PMOS transistor suitable for reducing the difference between the input voltage and the output voltage is used as an output driver. In this case, the smallest input/output voltage difference which is necessary for operation of LDO is substantially proportional to an on-resistance of the output voltage. Accordingly, in order to reduce the input/output difference in the same process, a W length of the output driver has to be made larger, which means an increase in an area of a gate.

On the other hand, the voltage regulator controls the output driver so that a reference voltage therein and a reference voltage for monitoring a voltage to be output by the voltage regulator are made equal to each other. To reduce fluctuations of the output voltage at a transient response time, such as an abrupt change of a load current, is determined depending on how soon a gate potential, which is a control terminal of the output driver, may be changed. The gate terminal of the output driver has a large parasitic capacitance. Therefore, in order to quickly change the gate potential, there is no way but making an operating current of a differential amplifier circuit larger, which serves as a charge/discharge current for the gate, or making a value of a gate capacitance smaller by reducing a gate area. This indicates the existence of a trade off between the input/output voltage difference and the current consumption, which leads designing of a voltage regulator having small power consumption to difficult.

As a structure in which current consumption is suppressed and transient response characteristics are improved, there is proposed a circuit as illustrated in FIG. 2.

A conventional voltage regulator illustrated in FIG. 2 monitors an output current with a transistor 6 connected in parallel with an output transistor 9, and feeds back a current proportional to the output current to a tail current of a transistor 8, namely, a differential amplifier circuit. With this circuit structure, an operating current of the differential amplifier circuit increases in proportional to an output current of the voltage regulator. Accordingly, it is possible to improve the transient response characteristics under heavy load while suppressing current consumption of the voltage regulator under light load.

Further, as a technique of reducing power consumption other than the technique described above, it is effective in reducing power consumption to provide two states including a normal operation state in which the voltage regulator itself is subjected to a regulation operation of the output voltage and a standby operation state in which the regulation operation is stopped to reduce the current consumption of the voltage regulator itself.

However, in the conventional voltage regulator having the structure illustrated in FIG. 2, aside from the feedback system for a normal output voltage signal, there exists a feedback system for feeding back the output current to a differential amplifier circuit. Therefore, in a case where operating points of both the systems are simultaneously moved, the operation may become unstable due to interaction of the respective feedback systems.

SUMMARY OF THE INVENTION

The present invention has been made in view of the above-mentioned problems, and an object thereof is to provide a voltage regulator that stably operates even in a case where operating points of both feedback systems are simultaneously moved.

Hence, a voltage regulator according to the present invention is configured to detect a state in which an absolute value of a difference between a reference voltage and a referred voltage becomes larger than a predetermined value, and make moderate the fluctuations of an operating point due to a feedback system of the output current during a given period of time since the detection, thereby suppressing an unstable operation. Further, the voltage regulator is configured to detect a state in which the reference voltage and the referred voltage are not equal to each other, and stop the fluctuations of output current during a given period of time since that state and then start a feedback operation of the output current after a given period of time.

Further, in a voltage regulator including the above-mentioned standby operation state and normal operation state, the period of time during which the reference voltage and the referred voltage are not equal to each other exists in a period of time in which the standby operation state is transferred to the normal operation state. Accordingly, the voltage regulator is configured to detect the state transition from the standby operation state to the normal operation state, and make moderate the fluctuations of an operating point due to a feedback system of the output current during a given period of time since that state, thereby suppressing an unstable operation. Moreover, the voltage regulator is configured to detect the state transition from the standby operation state to the normal operation state, and stop the fluctuation of the output current during a given period of time since that state and then start a feedback operation of the output current after a given period of time.

The essence of the present invention is to provide a delay to fluctuations of an operating point in the feedback system of the output current with respect to the fluctuations of an operating point of a normal feedback system. Therefore, it is apparent that the same effect can also be obtained with a structure in which the feedback system itself of the output current detects an abrupt increase of the output current to make moderate an increase of current in a differential amplifier circuit.

According to the voltage regulator of the present invention, there is employed a circuit structure in which a state where an absolute value of a difference between a reference voltage and a referred voltage becomes larger than a predetermined value and the fluctuations of an operating point due to a feedback system of the output current is made moderate during a given period of time since that state. Therefore, it is possible to provide a voltage regulator capable of improving the transient response characteristics under heavy load while suppressing the power consumption under light load, in which performance stability in a transient response is improved.

DETAILED DESCRIPTION OF THE PREFERRED EMBODIMENTS

Figure 1:
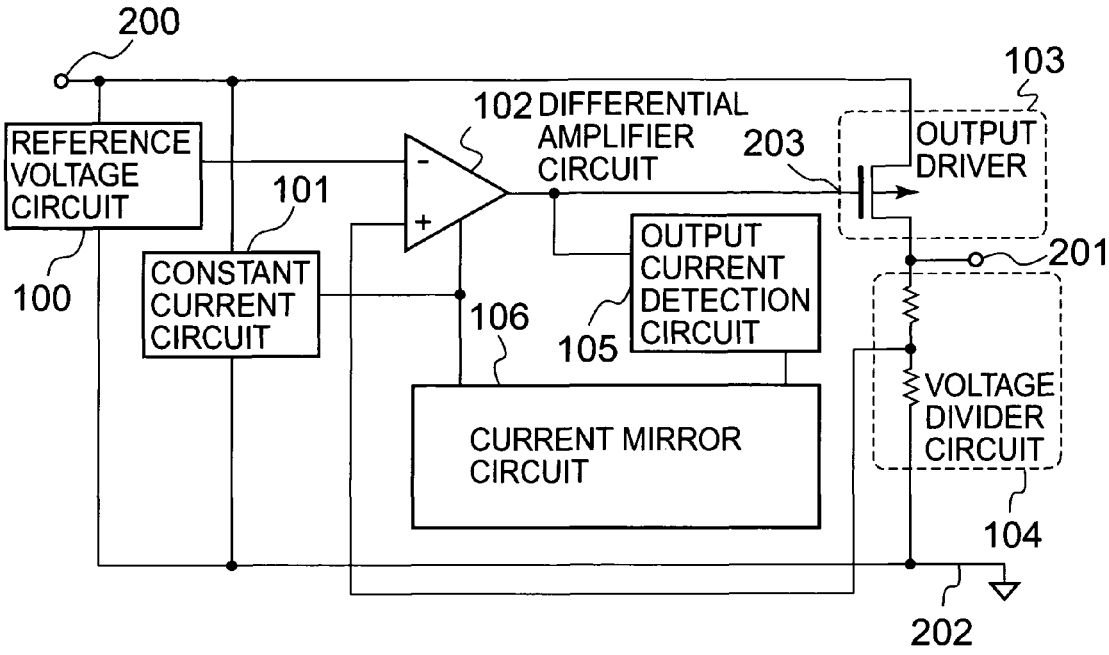
FIG. 1 is a block diagram illustrating a conceptual example of a voltage regulator according to the present invention.

FIG. 1 is a diagram illustrating a concept of a voltage regulator according to the present invention.

The voltage regulator according to the present invention includes a reference voltage circuit 100, a constant current circuit 101, a differential amplifier circuit 102, an output driver 103, a voltage divider circuit 104, an output current detection circuit 105, and a current mirror circuit 106.

Figure 2:
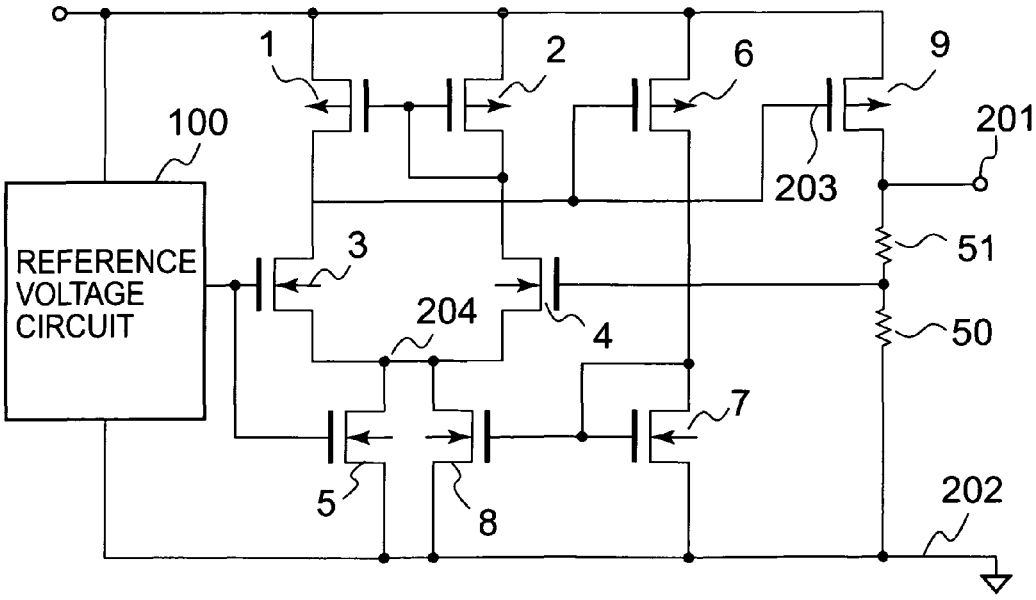
FIG. 2 PRIOR ART
FIG. 2 is a circuit diagram illustrating a conventional voltage regulator.

The reference voltage circuit 100 is connected between an input terminal 200 input with a power supply voltage and a ground terminal 202, and supplies a constant reference voltage VREF to an inverting input terminal of the differential amplifier circuit 102, irrespective of an input voltage. The output driver 103 is connected to the input terminal 200 and an output terminal 201, and a control terminal 203 of the output driver 103 is controlled based on an output of the differential amplifier circuit 102. The constant current circuit 101 is connected between the input terminal 200 and the ground terminal 202 and supplies a constant current to the differential amplifier circuit 102. Note that, as a transistor 5 as illustrated in FIG. 2, the constant current circuit 101 may employ a MOS transistor applied with the constant reference voltage VREF between a gate and a source thereof. The voltage divider circuit 104 is connected between the output terminal 201 and the ground terminal 202, and supplies a referred voltage VFB obtained by dividing an output voltage at a predetermined division ratio to a non-inverting input terminal of the differential amplifier circuit 102.

The differential amplifier circuit 102 compares the constant reference voltage VREF with the referred voltage VFB based on the output voltage and controls the output driver 103 so that the reference voltage VREF and the referred voltage VFB are made equal to each other, thereby operating so that an output voltage of the output terminal 201 is constant, irrespective of the output current. The output current detection circuit 105 detects a potential of the control terminal 203 of the output driver 103 and inputs a current corresponding to the output current to the current mirror circuit 106. Note that the output current detection circuit 105 may detect a current itself that flows into the output driver 103. The current mirror circuit 106 supplies a current based on the output current supplied from the output current detection circuit 105 serving as a current detection means to a current supply terminal 204 of the differential amplifier circuit 102. Through this feedback of the current, in a case where the output current is 0, the current supply to the differential amplifier circuit 102 is performed only from the constant current circuit 101, with the result that current consumption can be reduced. On the other hand, in a case where an amount of the output current is large, in addition to a current supplied from the constant current circuit 101, a current corresponding to the output current is supplied to the differential amplifier circuit 102, whereby transient response characteristics are improved.

In this case, the current mirror circuit 106 has a function of, depending on an operation state of the voltage regulator, delaying an operation for changing an operating current of the differential amplifier circuit 102 after the output current of the output current detection circuit 105 is changed. Accordingly, at a transient response time such as an abrupt increase of the output current, owing to an effect of the current mirror circuit 106, a change of the referred voltage VFB is fed back and thus a change in operating point in the circuit precedes, and thereafter, an operating current of the differential amplifier circuit 102 increases due to an increase of the output current. For that reason, the change in operating point due to the feedback of the current is slower or more moderate than the change in operating point in the feedback of the referred voltage VFB, whereby an unstable operation can be suppressed by an interaction between the respective feedback systems, which arises from the fact that the operating points of both the feedback systems are moved simultaneously.

First Embodiment

Figure 3:
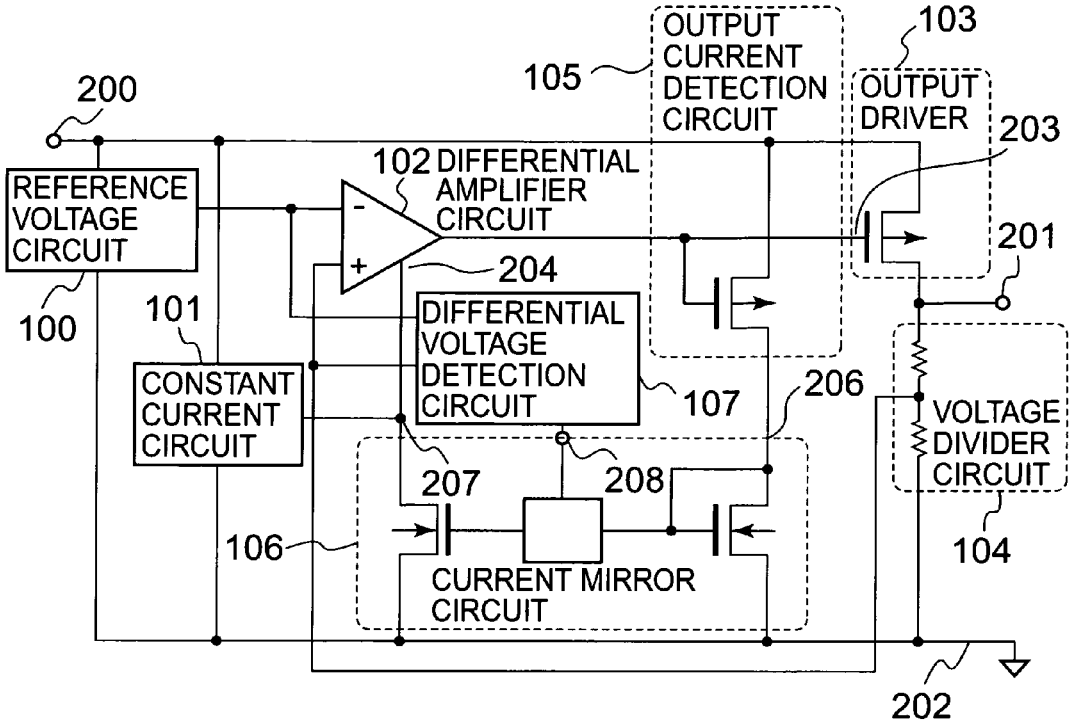
FIG. 3 is a circuit diagram illustrating a voltage regulator according to a first embodiment of the present invention.

FIG. 3 is a circuit diagram of a voltage regulator according to a first embodiment of the present invention.

The voltage regulator according to the first embodiment of the present invention includes a reference voltage circuit 100, a constant current circuit 101, a differential amplifier circuit 102, an output driver 103, a voltage divider circuit 104, an output current detection circuit 105, a current mirror circuit 106, and a differential voltage detection circuit 107.

The reference voltage circuit 100 is connected between an input terminal 200 input with a power supply voltage and a ground terminal 202, and supplies a constant reference voltage VREF to an inverting input terminal of the differential amplifier circuit 102, irrespective of an input voltage. The output driver 103 is connected to the input terminal 200 and an output terminal 201, and a control terminal 203 of the output driver 103 is controlled based on an output of the differential amplifier circuit 102. The voltage divider circuit 104 is connected between the output terminal 201 and the ground terminal 202, and supplies a referred voltage VFB obtained by dividing an output voltage at a predetermined division ratio to a non-inverting input terminal of the differential amplifier circuit 102. The reference voltage VREF and the referred voltage VFB based on the output voltage are input into the input terminals of the differential amplifier circuit 102. An output terminal of the differential amplifier circuit 102 is connected to a control terminal 203 of the output driver 103. The constant current circuit 101 is connected between the input terminal 200 and the ground terminal 202 and supplies a constant current to a current supply terminal 204 of the differential amplifier circuit 102.

The output current detection circuit 105 is formed of a PMOS transistor connected in parallel to the control terminal 203 of the output driver 103 and inputs a current proportional to the output current into the current mirror circuit 106. The current mirror circuit 106 supplies a current based on the current supplied from the output current detection circuit 105 to the current supply terminal 204 of the differential amplifier circuit 102.

Figure 5:
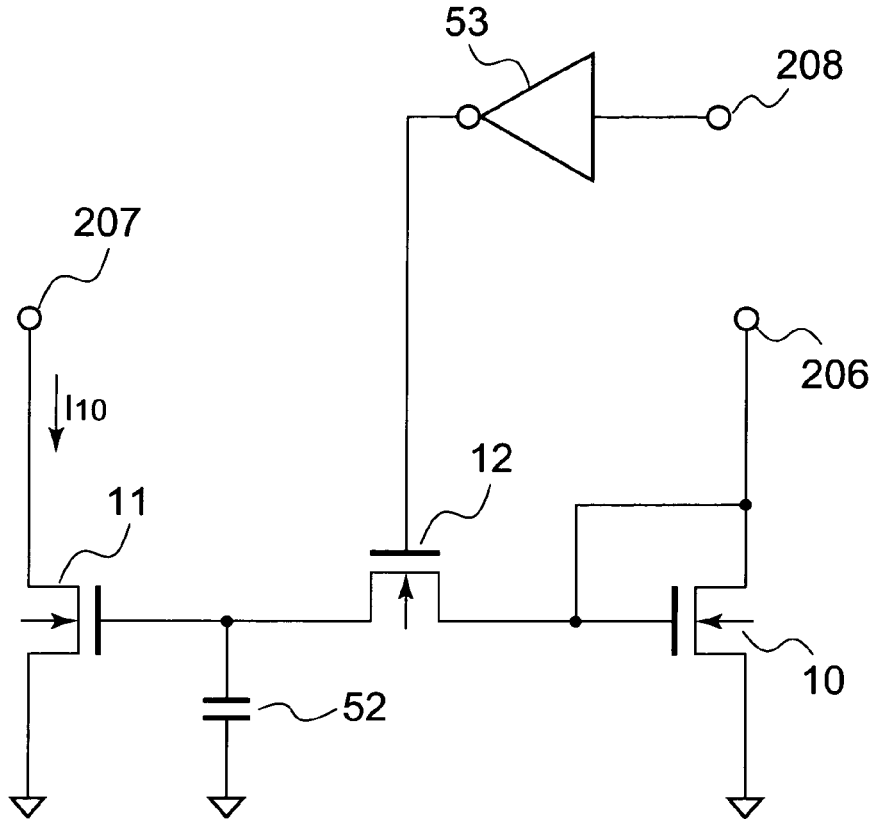
FIG. 5 is a circuit diagram illustrating an example of a current mirror circuit of the voltage regulator according to the first embodiment of the present invention.

The current mirror circuit 106 is a so-called switched current circuit as illustrated in FIG. 5. A current input terminal 206 is connected to a gate terminal and a drain terminal of an NMOS transistor 10. A current output terminal 207 is connected to a drain terminal of an NMOS transistor 11. A capacitor 52 is connected between a gate terminal and a source terminal of the NMOS transistor 11. Between the gate terminals of the NMOS transistors 10 and 11, an NMOS transistor 12 that operates as a switch is connected. A gate terminal of the NMOS transistor 12 is controlled by a control terminal 208 through an inverter circuit 53.

The differential voltage detection circuit 107 compares the reference voltage VREF output by the reference voltage circuit 100 with the referred voltage VFB output by the voltage divider circuit 104 to thereby output a signal for controlling the control terminal 208 of the current mirror circuit 106.

Figure 6:
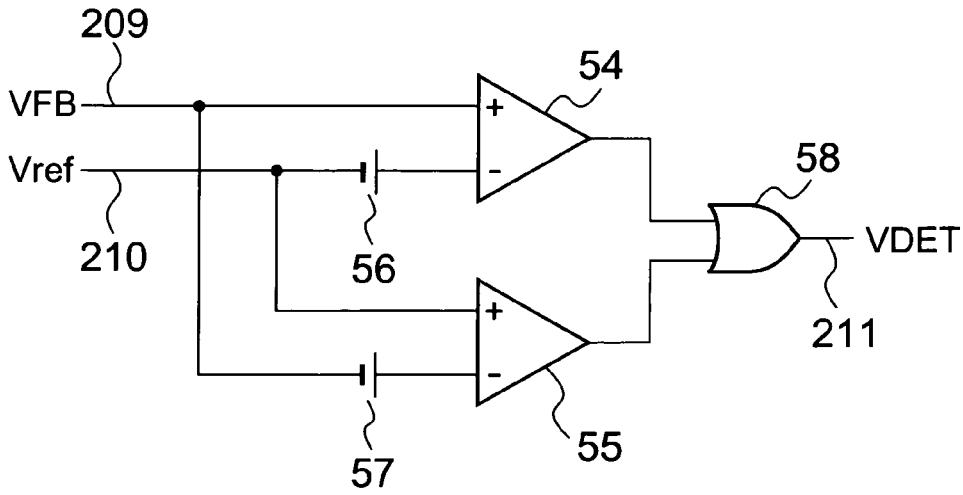
FIG. 6 is a circuit diagram illustrating an example of a differential voltage detection circuit of the voltage regulator according to the first embodiment of the present invention.

A configuration example of the differential voltage detection circuit 107 is illustrated in FIG. 6. The referred voltage VFB and the reference voltage VREF are input into an input terminal 209 and an input terminal 210, respectively. Into a comparator 54, the reference voltage VREF added with an offset voltage 56 and the referred voltage VFB are input. Into a comparator 55, the referred voltage VFB added with an offset voltage 57 and the reference voltage VREF are input. Based on the respective comparison results, a logical sum is obtained by an OR circuit 58 and is output as a control signal VDET to an output terminal 211. The output terminal 211 is connected to the control terminal 208 of the current mirror circuit 106.

The voltage regulator according to the first embodiment of the present invention as configured above operates as follows and achieves a performance stability in the transient response.

The differential amplifier circuit 102 compares the reference voltage VREF output by the reference voltage circuit 100 with the referred voltage VFB obtained by dividing the output voltage by the voltage divider circuit 104 and controls the control terminal 203 of the output driver 103, thereby operating so that a voltage of the output terminal 201 becomes constant.

An operating current of the differential amplifier circuit 102 is controlled by currents that are allowed to flow by the constant current circuit 101 and the current mirror circuit 106. The current allowed to flow by the current mirror circuit 106 has a value obtained by mirroring a current proportional to the output current allowed to flow by the output current detection circuit 105 based on a current mirror ratio that is set in the NMOS transistors 10 and 11. The current mirror circuit 106 is a switched current circuit, and an operation thereof is controlled by the control signal VDET of the differential voltage detection circuit 107.

In the differential voltage detection circuit 107 of FIG. 6, the referred voltage VFB input into the input terminal 209 and the reference voltage VREF input into the input terminal 210 are compared with a voltage to which the offset voltage 56 is added and a voltage to which the offset voltage 57 is added in the comparator 54 and the comparator 55, respectively. Then, in a case where the referred voltage VFB is larger than the sum of the reference voltage VREF and the offset voltage 56, or in a case where the reference voltage VREF is larger than the sum of the referred voltage VFB and the offset voltage 57, the output terminal 211 outputs a signal H. Conversely, in a case where the referred voltage VFB is smaller than the sum of the reference voltage VREF and the offset voltage 56 and the reference voltage VREF is smaller than the sum of the referred voltage VFB and the offset voltage 57, the output terminal 211 outputs a signal L. In other words, the output signal is changed according to a magnitude of the absolute value |VREF−VFB| of the difference between the reference voltage VREF with the offset voltage 56 and the referred voltage VFB with the offset voltage 57. The output signal is input into the control terminal 208 of the current mirror circuit 106.

When the signal L is input into the control terminal 208 in the current mirror circuit 106 of FIG. 5, a gate potential of the NMOS transistor 12 becomes H, and a conductive state is obtained between the source terminal and the drain terminal thereof, whereby a current mirror operation is performed. On the other hand, when the signal H is input into the control terminal 208, a gate potential of the NMOS transistor 12 becomes L, whereby a path between the gates of the NMOS transistors 10 and 11 enters an insulating state. In this case, the capacitor 52 retains a gate-source voltage before the NMOS transistor 11 enters the insulating state. As a result, the output current of the NMOS transistor 11, namely, the output current of the current output terminal 207 is a current immediately before the potential of the control terminal 208 is transferred to H, which is being output.

Through the operation as described above, the fluctuations of the output voltage are fed back as an operating current of the differential amplifier circuit 102, owing to the current allowed to flow by the current mirror circuit 106. Through the feedback of the current, in a case where the output current is 0, the operating current is supplied to the differential amplifier circuit 102 only from the constant current circuit 101, whereby current consumption can be reduced. On the other hand, in a case where the output current is large, in addition to a current supplied from the constant current circuit 101, a current corresponding to the output current is supplied from the current mirror circuit 106, whereby the transient response characteristics of the differential amplifier circuit 102 are improved.

FIGS. 8A to 8D are graphs illustrating changes of a voltage and a current at each junction of the voltage regulator according to the first embodiment of the present invention.

Figure 8A:
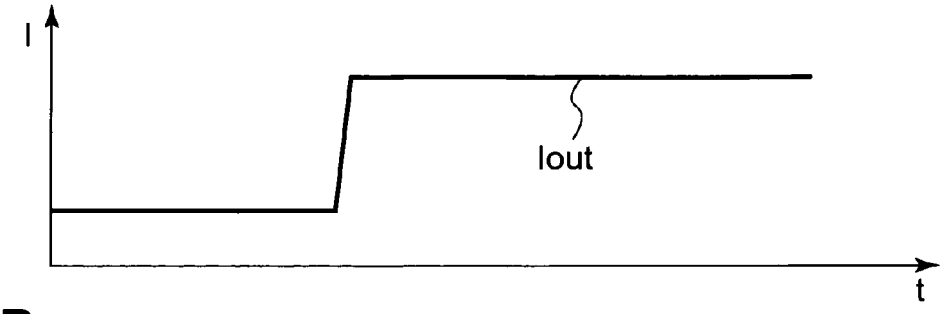
FIGS. 8A to 8D are graphs illustrating changes of a voltage and a current at each junction of the voltage regulator according to the first embodiment of the present invention.
Figure 8B:
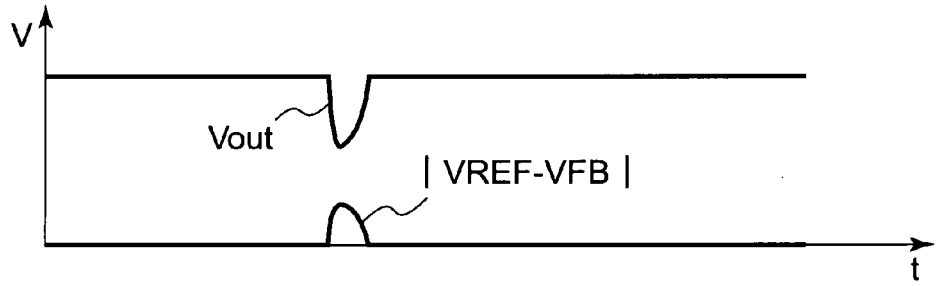
Figure 8C:
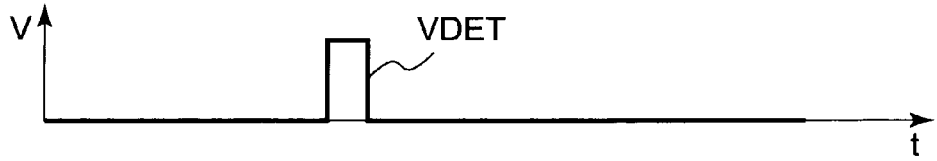
Figure 8D:
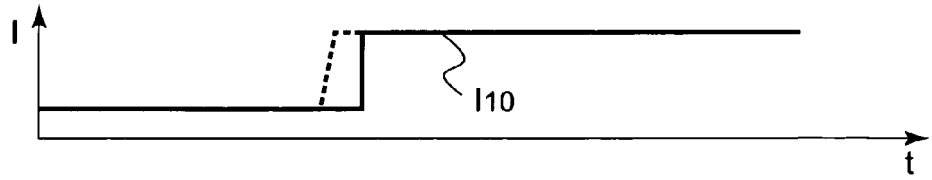

In a case where an output current Iout increases as illustrated in FIG. 8A, an output voltage Vout cannot follow the increase as illustrated in FIG. 8B, whereby undershoot occurs. As a result, the referred voltage VFB also causes undershoot, whereby the absolute value |VREF−VFB| of a differential voltage becomes large. In a case where the absolute value |VREF−VFB| of the differential voltage is larger than the offset voltages 56 and 57, the output signal VDET of the differential voltage detection circuit 107 becomes H as illustrated in FIG. 8C. Accordingly, as in FIG. 8D, in a time period during which the potential of the control terminal 208 of the current mirror circuit 106 is H after being transferred from L to H, the current flowing into the current output terminal 207 does not change. The retention of the drain current I10 of the NMOS transistor 11, namely, the retention of the current flowing into the current output terminal 207 is continued until the absolute value |VREF−VFB| of the differential voltage is smaller than the offset voltages 56 and 57 and the potential of the control terminal 208 is transferred to L again. After the potential of the control terminal 208 is transferred to L, the current mirror circuit 106 is transferred to perform a normal current mirror operation, whereby the operating current of the differential amplifier circuit 102 increases or decreases according to the fluctuations of the output current.

As a result, when the output current abruptly increases, owing to an effect of the current mirror circuit 106, a change of the referred voltage VFB causes the feedback and thus a change in operating point in the circuit precedes, and thereafter, an operating current of the differential amplifier circuit 102 increases due to an increase of the output current. For that reason, the change in operating point due to a feedback of the current occurs later than the change in operating point in the feedback of the referred voltage VFB, whereby an unstable operation can be suppressed by an interaction between the feedback systems, which arises from the fact that the operating points of both the feedback systems are moved simultaneously.

Second Embodiment

Figure 4:
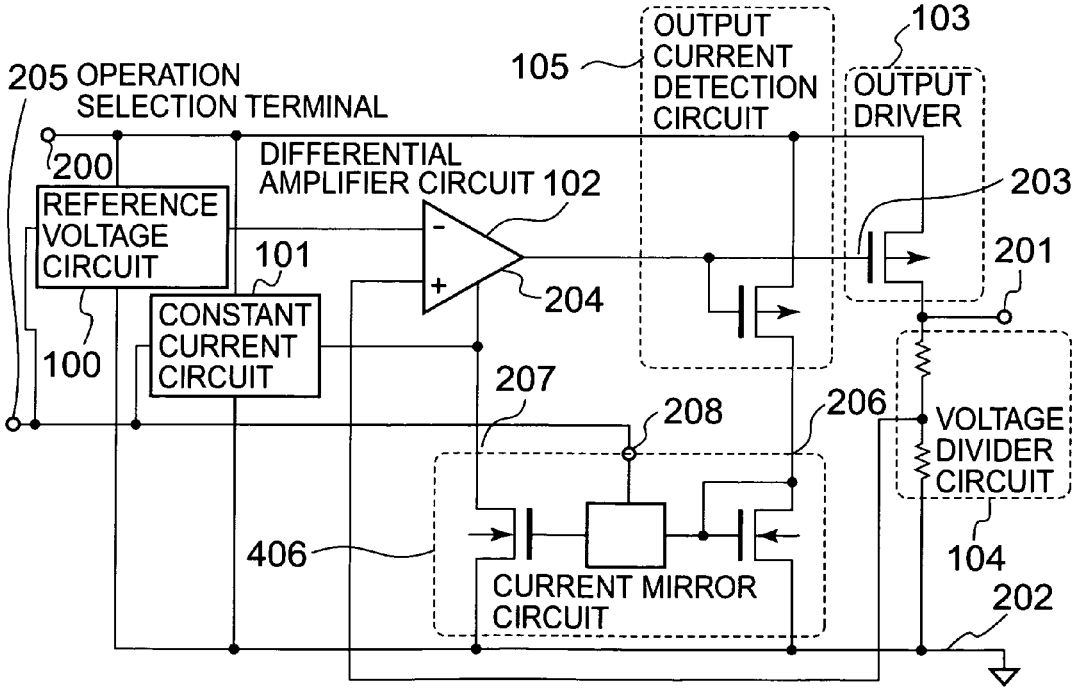
FIG. 4 is a circuit diagram illustrating a voltage regulator according to a second embodiment of the present invention.

FIG. 4 is a circuit diagram of a voltage regulator according to a second embodiment of the present invention.

The voltage regulator according to the second embodiment of the present invention includes a reference voltage circuit 100, a constant current circuit 101, a differential amplifier circuit 102, an output driver 103, a voltage divider circuit 104, an output current detection circuit 105, and a current mirror circuit 406. The voltage regulator according to the second embodiment is different from the voltage regulator according to the first embodiment of FIG. 3, in that the current mirror circuit 406 instead of the current mirror circuit 106 and an operation selection terminal 205 instead of the differential voltage detection circuit 107 are provided.

Operations other than those of the current mirror circuit 406 and the operation selection terminal 205 are the same as those of the voltage regulator according to the first embodiment of FIG. 3, and hence description thereof is omitted.

The voltage regulator according to the second embodiment of the present invention is, for example, in a normal operation state when the operation selection terminal 205 is in H level, and in a standby operation state for low consumption when the operation selection terminal 205 is in L level. In the case of the standby operation state, the respective circuits including the reference voltage circuit 100 and the constant current circuit 101 are stopped.

Figure 7:
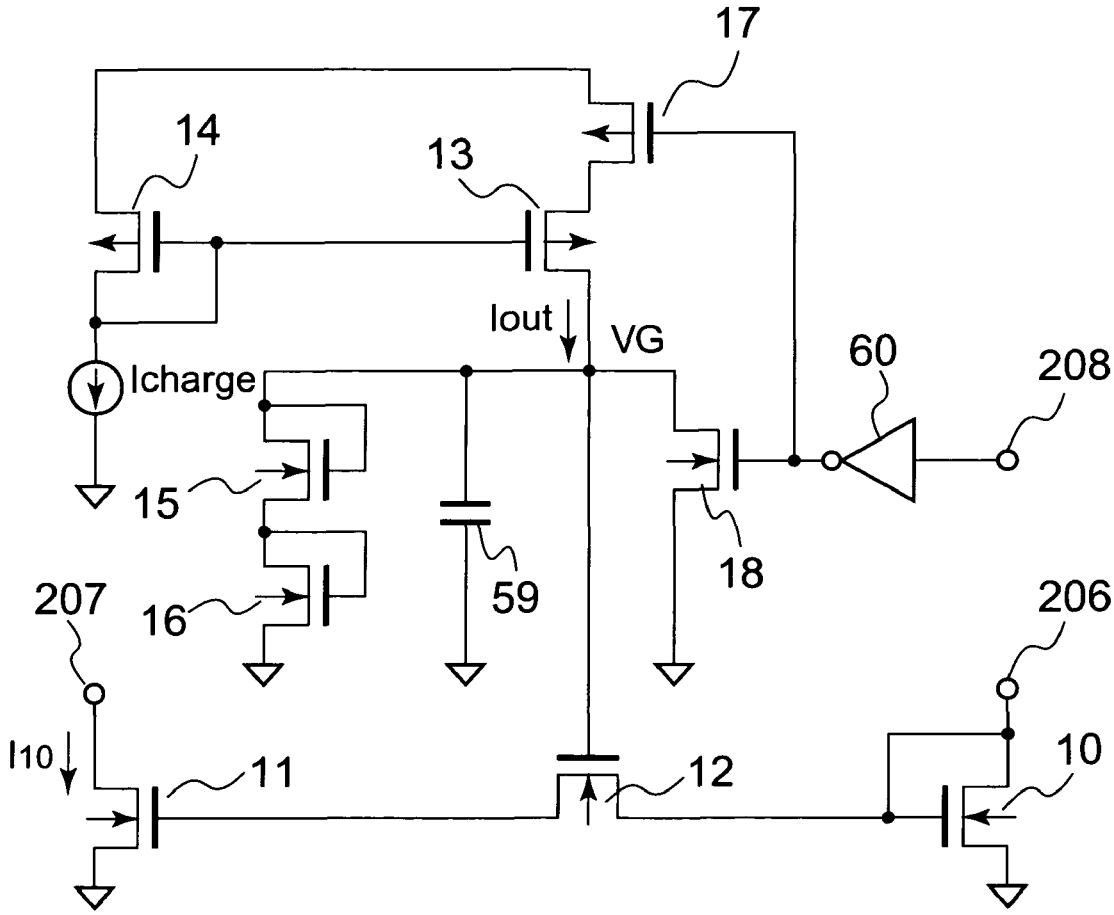
FIG. 7 is a circuit diagram illustrating an example of a current mirror circuit of the voltage regulator according to the second embodiment of the present invention.

FIG. 7 is a circuit diagram of the current mirror circuit 406 of the voltage regulator according to the second embodiment of the present invention.

The current mirror circuit 406, which includes terminals 206, 207, and 208 and NMOS transistors 10 and 11, has the same configuration as that of the current mirror circuit 106.

In the current mirror circuit 406, an NMOS transistor 12 that operates as a variable resistor is connected between gates of the NMOS transistors 10 and 11. A capacitor 59 is connected to a gate terminal of the NMOS transistor 12. PMOS transistors 13 and 14 form a current mirror circuit. The current mirror circuit charges the capacitor 59 with a constant current Iout obtained by mirroring a constant current Icharge. A PMOS transistor 17 controls an operation of the current mirror circuit according to a signal of the control terminal 208. An NMOS transistor 18 is connected to the capacitor 59 and controls a charge/discharge operation of the capacitor 59 based on the signal of the control terminal 208. Transistors 15 and 16 are connected to the capacitor 59 and clamp-controls a charge voltage of the capacitor 59.

The voltage regulator of the second embodiment as configured above operates as follows and includes a function of stably operating the voltage regulator.

FIGS. 9A to 9D are graphs illustrating changes of a voltage and a current at each junction of the voltage regulator according to the second embodiment of the present invention.

When the operation selection terminal 205 is input with L, that is, when a voltage V208 of the control terminal 208 is L, the NMOS transistor 18 enters a conductive state, and the PMOS transistor 17 enters an interrupted state. In this state, the NMOS transistor 12 is in the interrupted state, a gate of the NMOS transistor 11 is not applied with a voltage, an output current of the current output terminal 207 is 0. Further, the capacitor 59 is discharged by the NMOS transistor 18.

Figure 9A:
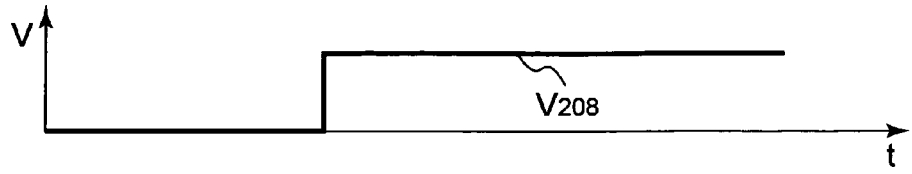
FIGS. 9A to 9D are graphs illustrating changes of a voltage and a current at each junction of the voltage regulator according to the second embodiment of the present invention.
Figure 9B:
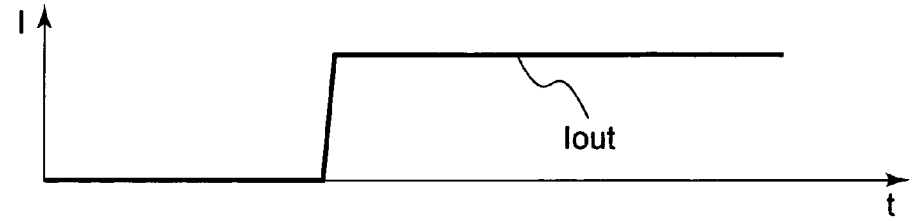
Figure 9C:
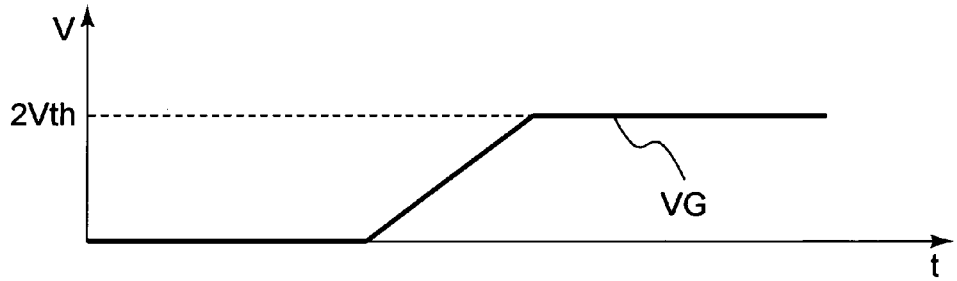
Figure 9D:
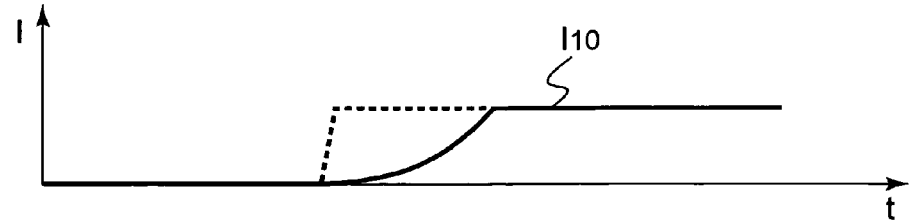

As illustrated in FIG. 9A, when the operation selection terminal 205 is input with H, that is, when the voltage V208 of the control terminal 208 is changed into H, the NMOS transistor 18 enters the interrupted state and the PMOS transistor 17 enters the conductive state. Based on the operation of the current mirror circuit, the capacitor 59 is charged with the constant current Iout as illustrated in FIG. 9B. As illustrated in FIG. 9C, a charge voltage VG of the capacitor 59 increases with a constant slope. Accordingly, an on-resistance of the NMOS transistor 12 decreases gently, and as a result, a current of the current output terminal 207 also increases gradually as illustrated in FIG. 9D.

When the charge voltage VG of the capacitor 59 becomes approximate to a sum of threshold voltages of the transistors 15 and 16, the charge current starts to flow into the transistors 15 and 16, whereby the increase of the charge voltage VG of the capacitor 59 stops. Accordingly, the charge voltage VG of the capacitor 59 is clamped to a voltage that is a sum of the threshold voltages of the transistors 15 and 16. In this case, the on-resistance of the NMOS transistor 12 is sufficiently decreased, and hence the NMOS transistors 11 and 10 operate similarly to a normal current mirror circuit. As a result, a current I10 that flows into the transistor 11 of the current mirror circuit 406, namely, a current flowing into the current output terminal 207, gradually changes with respect to a change of the output current Iout when a standby state is changed into the normal state.

In the voltage regulator of the second embodiment as described above, owing to the operation of the current mirror circuit 406, the operating point due to the increase of the output current fluctuates gradually with respect to the fluctuations of the operating point due to the feedback system of the referred voltage VFB when the voltage regulator changes from the standby state to the operation state. Accordingly, the voltage regulator can operate stably by interaction between the respective feedback systems, which results from the fact that both the operating points of the respective feedback systems are simultaneously moved.

Note that it is apparent that, as to the switching between the normal operation state and the standby operation state in the second embodiment of the present invention, the same effect can also be obtained in the structure in which the switching is automatically performed in the inside the voltage regulator without depending on external terminals.

Further, the second embodiment of the present invention has described an embodiment of the case where the regulating operation is not conducted in the standby operation state. It is apparent that the same effect can also be obtained in the standby operation state in which the regulation is conducted in a suppressed state of the current consumption.

Further, it is apparent that, even when the delay of the current mirror circuit is realized by making a fluctuation rate per unit time of the operating current in the differential amplifier circuit small with respect to the rate of change of the output current per unit time, the same effect can also be obtained.

What is claimed is:

1. A voltage regulator, comprising:

a differential amplifier circuit for amplifying a difference between a referred voltage obtained by dividing a voltage output with an output transistor and a reference voltage to be output, and for controlling a gate of the output transistor;

a current source for supplying an operating current of the differential amplifier circuit;

an output current detection circuit for outputting a current based on a current flowing into the output transistor; and a current mirror circuit for changing the operating current of the differential amplifier circuit, based on an output current of the output current detection circuit, wherein the current mirror circuit provides a delay to an operation for changing the operating current of the differential amplifier circuit after the output current of the output current detection circuit changes based on an operation state of the voltage regulator.

2. A voltage regulator according to claim 1, wherein the current mirror circuit detects a change of the current flowing into the output transistor and provides the delay.

3. A voltage regulator according to claim 1, wherein the current mirror circuit detects that an absolute value of the difference between the referred voltage and the reference voltage is equal to or larger than a predetermined value to provide the delay.

4. A voltage regulator according to claim 1, wherein:

the voltage regulator has a normal operation state and a standby operation state for a low consumption operation; and the current mirror circuit detects a state transition from the standby operation state to the normal operation state to provide the delay.

5. A voltage regulator according to claim 4, wherein the current mirror circuit changes an output current of the current mirror circuit after a given period of time from the detection of the operation state of the voltage regulator.

6. A voltage regulator according to claim 5, wherein the current mirror circuit comprises a switched current circuit.

7. A voltage regulator according to claim 4, wherein the delay of the current mirror circuit is realized by making smaller a rate of change in the operating current of the differential amplifier circuit per unit time with respect to a rate of change in the output current per unit time.

8. A voltage regulator according to claim 1, wherein the current mirror circuit changes an output current of the current mirror circuit after a given period of time from the detection of the operation state of the voltage regulator.

9. A voltage regulator according to claim 1, wherein the delay of the current mirror circuit is realized by making smaller a rate of change in the operating current of the differential amplifier circuit per unit time with respect to a rate of change in the output current per unit time.

* * * * *